US011541320B2

(12) United States Patent
Kim

(10) Patent No.: US 11,541,320 B2
(45) Date of Patent: Jan. 3, 2023

(54) PREFABRICATED TUNED TOP AND LAUNCHER FOR LAUNCHING TUNED TOP

(71) Applicant: Yong Cheol Kim, Seoul (KR)

(72) Inventor: Yong Cheol Kim, Seoul (KR)

( * ) Notice: Subject to any disclaimer, the term of this patent is extended or adjusted under 35 U.S.C. 154(b) by 0 days.

(21) Appl. No.: 17/261,012

(22) PCT Filed: May 13, 2019

(86) PCT No.: PCT/KR2019/005713
§ 371 (c)(1),
(2) Date: Jan. 16, 2021

(87) PCT Pub. No.: WO2020/017747
PCT Pub. Date: Jan. 23, 2020

(65) Prior Publication Data

US 2021/0291066 A1 Sep. 23, 2021

(30) Foreign Application Priority Data

Jul. 17, 2018 (KR) ..... 10-2018-0082768
Sep. 13, 2018 (KR) ..... 10-2018-0109577

(51) Int. Cl.
*A63H 1/04* (2006.01)
*A63H 1/10* (2006.01)
(Continued)

(52) U.S. Cl.
CPC ..... *A63H 1/04* (2013.01); *A63H 1/00* (2013.01); *A63H 1/10* (2013.01); *A63H 31/06* (2013.01)

(58) Field of Classification Search
CPC ... A63H 1/00; A63H 1/02; A63H 1/04; A63H 1/10; A63H 31/06
See application file for complete search history.

(56) References Cited

U.S. PATENT DOCUMENTS 575,278 A * 1/1897 Allen ..... A63H 1/00 446/264
755,446 A * 3/1904 Butcher ..... A63H 1/00 446/233
(Continued)

FOREIGN PATENT DOCUMENTS

JP 2000-197776 A 7/2000
JP 3088350 U 9/2002
(Continued)

OTHER PUBLICATIONS

WO2015/024347A1 translation (Year: 2015).*

*Primary Examiner* — Eugene L Kim
*Assistant Examiner* — Alyssa M Hylinski
(74) *Attorney, Agent, or Firm* — Im IP Law; Chai Im; C. Andrew Im

(57) ABSTRACT

A prefabricated tuned top and a launcher for launching the tuned top, manufactured in a small size with five components of a knob, a rim, beads, a body and a spinning spindle. The tuned top can be readily assembled by sequentially inserting and then tightening the components. The tuned top implements a changeable spinning form based on induction of a change in difference between the centripetal force and centrifugal force, generated during spinning, since the center of gravity can be eccentrically disposed freely according to the user's selection. The tuned top is prevented from being reversely loosened so it can be safely, semi-permanently, and easily enjoyable at any location. The tuned top enables accurate and stable mounting when a launcher is used, such that the top is not easily separated therefrom but is quickly launched without a launch failure, thereby providing accurate launching without the loss of spinning power.

15 Claims, 17 Drawing Sheets

(51) Int. Cl.
*A63H 31/06* (2006.01)
*A63H 1/00* (2019.01)

(56) References Cited

U.S. PATENT DOCUMENTS 1,780,547 A * 11/1930 Alland ..... A63F 9/16
446/256
3,309,813 A * 3/1967 Newlan ..... A63H 1/00
446/258
5,020,798 A * 6/1991 Yang ..... A63H 1/04
446/257
6,196,891 B1 * 3/2001 Jamison ..... A63H 1/30
446/250
6,364,734 B1 * 4/2002 Ng ..... A63H 1/18
446/236
6,743,070 B1 * 6/2004 Lin ..... A63H 33/28
446/259
2003/0077977 A1 * 4/2003 Polare ..... A63H 1/24
446/256
2005/0009437 A1 * 1/2005 Hendron ..... A63H 1/00
446/85
2008/0214088 A1 * 9/2008 Chu ..... A63H 1/06
446/248
2017/0173477 A1 * 6/2017 Shindo ..... A63H 1/04

FOREIGN PATENT DOCUMENTS

JP 2003-210854 A 7/2003
KR 20-0261196 Y1 1/2002
KR 10-2002-0011065 A 2/2002
KR 10-2015-0102386 A 9/2015
WO WO-03084627 A1 * 10/2003 ..... A63H 1/00
WO WO-2015024347 A1 * 2/2015 ..... A63H 1/00

* cited by examiner

FIG. 16
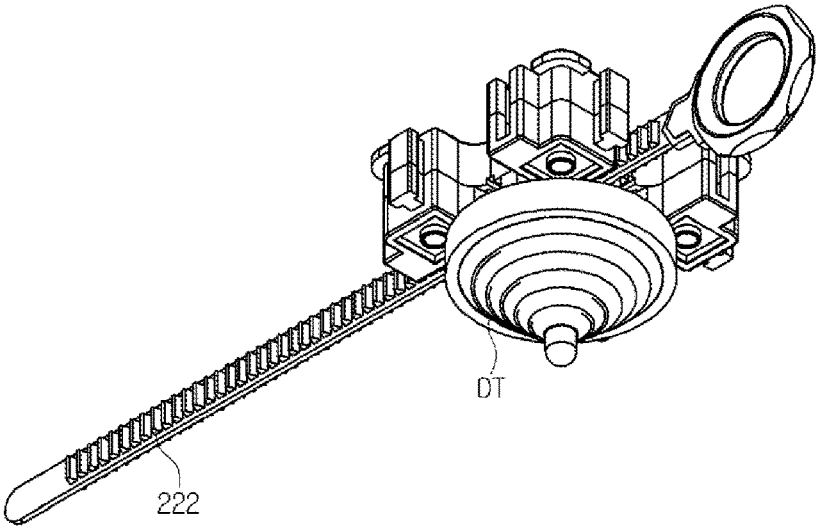
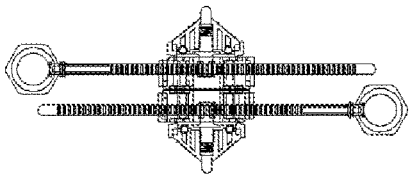
FIG. 17A
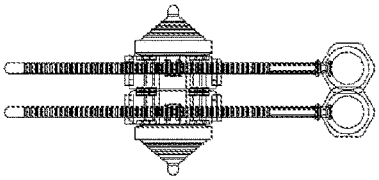
FIG. 17C
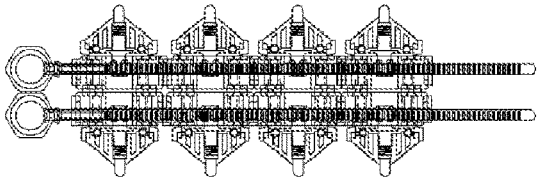
FIG. 17B
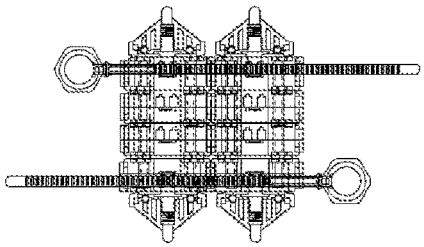
FIG. 17D
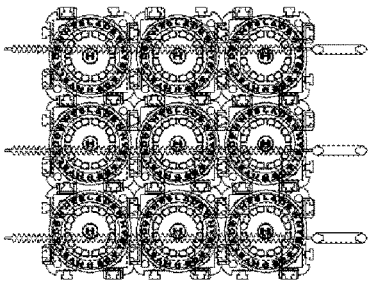
FIG. 17E

PREFABRICATED TUNED TOP AND LAUNCHER FOR LAUNCHING TUNED TOP

RELATED APPLICATION

This application is a § 371 application of PCT/KR2019/005713 filed May 13, 2019, which claims priority from Korean Patent Application No. 10-2018-0082768 filed Jul. 17, 2018 and No. 10-2018-0109577 filed Sep. 13, 2018, each of which is incorporated herein by reference in its entirety.

TECHNICAL FIELD

The present invention relates to a prefabricated tuned top and a launcher for launching the tuned top and, more specifically, to a prefabricated tuned top and a launcher for launching the tuned top, which: can be simply manufactured in a small size with only the five components of a knob, a rim, beads, a body and a spinning spindle; can be very easily assembled just by sequentially inserting and tightening the components; can implement a changeable spinning form by inducing a change in the difference between centripetal force and centrifugal force, which are generated during spinning, since the center of gravity can be eccentrically disposed freely according to the selection of a user; is prevented from being reversely loosened so that the user can safely, semi-permanently, and easily enjoy the top for pleasure at any location; and is accurately and stably mounted on the launcher not to be easily separated from the launcher, but is quickly launched from the launcher without a launch failure when the top is launched from the launcher, so as to be accurately launched without any loss of spinning power.

BACKGROUND OF THE INVENTION

Conventionally, a top is a play tool for a top-spinning game, which is one of Korean traditional folk games for children. The conventional top includes a top body made by chipping out of wood, and a spinning spindle fixed at the center of a lower end of the top body. The top-spinning game is performed in such a way that the top spins when a user hits the top body with a string fixed on a stick.

There are various kinds of top-spinning games: a long spinning game that persons make their tops spin longer after hitting their tops with their strings of the sticks so the person who makes his or her top spin the longest is the winner; a spinning top battle game that a spinning top of a person crashes against other's top and knocks over the other's top so the person whose top stops spinning is the loser; and a returning-to-start-line game that persons return to the start line while hitting their tops to make their tops spin and move accurately and faster till their tops return to the start line from a target so the person whose top returns to the start line the fastest.

The top-spinning games are mostly performed on the ice or in an outdoor space to secure a sufficient space. So, due to rapid industrialization, tendency of nuclear families, and high advancement of play tools, such as toys, the top-spinning becomes one of experience game cultures that people can experience in tourist attractions or experience centers.

Recently, with development of toy tops that children can play indoors, the toy tops became very popular among children. So, the game culture that a child makes his or her top crash against other's top and the child whose top spins the longest or flicks the other's top off a top board is the winner has been established.

Such tops are classified into string tops, launcher tops, and finger tops, and the following Table 1 shows merits and demerits of the above-mentioned tops.

TABLE 1

| Div. | String top | Launcher top | Finger top |
|---|---|---|---|
| Concept | After a user connects the knob and the central spindle with a string and winds the string on the inclined surface of a lower portion of the top body while making concentric circles, the user throws the top on which the string is wound toward the floor, then the top is separated from the string by a centrifugal force and spins on the floor. | This top spins by a separate top-spinning tool (launcher or shooter) instead of a string. | When a user grips the knob of the top with fingers and releases the top while turning the top, the top spins. |
| Merit | It is a traditional top, and anyone can enjoy it easily and rapidly if he or she is skilled at the top.<br>The user can adjust the spinning speed according to ways to wind the string or ways to throw the top. | Anyone can spin the top easily without any skill.<br>The user can adjust the spinning speed according to the speed of pulling a winder. | There is no need to use a string or a launcher.<br>Anyone can spin the top easily without any skill.<br>Children can enjoy spinning tops even in a narrow space, such as on a table or on the palm, since the diameter of the top is less than 3 cm. Namely, children can play with the top anywhere.<br>It is not dangerous and is safe.<br>It is easy to carry. |
| Demerit | It is difficult to tightly wind the string to make the top spin.<br>It is difficult to play with | It is difficult to obtain wanted spinning force of the top due to a loss of | It is difficult to be higher in spinning force than the launcher top or the string top. |

TABLE 1-continued

| Div. | String top | Launcher top | Finger top |
|---|---|---|---|
| | the top indoors since the sharp spinning spindle stabs the floor when the thrown top drops on the floor.<br>It is dangerous when being thrown toward a person.<br>Just a skilled person can spin the top. | spinning force of the top in an aspect of the structure of a launcher. | |

Because of the above-mentioned differences, there are limitations in utilizing as the string top, the launcher top or the finger top. Combined tops may be used in such a way that the function of the string top is added to the launcher top or the function of the launcher top is added to the string top, but the string top or the launcher top is not used as the finger top. Especially, due to the nature of the launcher having the combination of a rack and a pinion gear, in consideration of the height, width, and gear mesh of gears mounted in the launcher, the launcher top must be about 50 mm or more in diameter. Then, the user cannot spin the launcher top at a strong centrifugal force just by a finger since the launcher top increases in weight and volume.

Moreover, the finger top is a miniature top of a tiny size, and is less than 30 mm in diameter so as to be spined by a finger, and must have a knob so that the user can grip and spin with the finger.

However, since the string top has no knob and the launcher top has a knob changed in structure for gear meshing, the string top and the launcher top are inappropriate for spinning by the finger.

In the meantime, Japanese Patent Laid-open No. 2000-197776 (Jul. 18, 2000) discloses a top having a bottom member, a body member and a head member which are separable from one another, so as to be easily replaceable and to provide weight changing means and a suspension function. Therefore, the top increases safety since the top has changeable spinning force and impulsive force when a person plays with the top and absorbs shock when crashing onto other's top, and the user can enjoy spinning his or her own top since optional articles can be added to the top freely.

However, the top disclosed in Japanese Patent Laid-open No. 2000-197776 has several disadvantages in that it is complicated in structure and it is difficult to assemble since the top must have a suspension unit, and a fastening screw and an adjusting screw for fastening the suspension unit, must be specified in location of the top, and must have a coupling structure to screw the head member and the bottom member to the body member.

Additionally, the string top which is not usable as the finger top has a string to be wound on the body member. The top disclosed in Japanese Patent Laid-open No. 2000-197776 has a groove formed in the circumference of the body member so that the user can easily wind the string on the top. Therefore, the top disclosed in Japanese Patent Laid-open No. 2000-197776 is clearly a string top.

In addition, the finger top is characterized by a knob protruding long so that a user can spin the top with the fingers. However, the top disclosed in Japanese Patent Laid-open No. 2000-197776 does not have a knob but has an upper cap. The upper cap is just a cap for protecting an adjustable screw mounted to adjust an elastic restoring force of the suspension.

Moreover, because a shaft member has a structure that a bearing spring and a bearing are embedded in order to strengthen an elastic buffering function, in view of the concept of the Table 1, the top disclosed in Japanese Patent Laid-open No. 2000-197776 is not the finger top but is clearly a string top. It is difficult to miniaturize the top like the finger top with the size of less than 3 cm due to the complicated structure.

Meanwhile, Japanese Utility Model Registration No. 3088350 (Jun. 19, 2002) discloses a launcher top of which spinning characteristics are changed when spinning at low speed and when spinning at high speed.

The launcher top can secure variety in playing the top without additional expenses since changing its spinning characteristics without purchase and replacement of additional parts.

However, because the top disclosed in Japanese Utility Model Registration No. 3088350 is clarified as the launcher top spinning by a shooter, it is difficult to be used as a finger top based on the concept of the Table 1.

Especially, the top disclosed in Japanese Utility Model Registration No. 3088350 includes a magnet disposed at the center of the top and a magnetic core touching the magnet, wherein a lower end of the magnetic core is located in an exposed space, the space is notched with the outside and movable iron beads are contained in the space. Therefore, the launcher top can obtain a change in speed, namely, a change in the number of rotations, by a change in location of the iron beads since the iron beads are adsorbed onto the magnetic core by a magnetic force of the magnetic core during a low-speed rotation and are separated from the magnetic core to be away from the magnetic core while a centrifugal force increases during a high-speed rotation.

As described above, the top disclosed in Japanese Utility Model Registration No. 3088350 has several disadvantages in that it is complicated and difficult to mold since having the magnetic core, a space for mounting the magnetic core, the magnet embedded therein, and the arrangement that the magnetic core gets in contact with the magnet, and since a lower layer member, a middle layer member and an upper layer member must be molded to have a specific fitting assembly structure, and in that it is structurally inconvenient to assemble since having additional insertion pieces and a storage part. Furthermore, the launcher top has only the storage part structure to be coupled with the shooter but does not have a knob which is the feature of the finger top. On the contrary, because the finger top has a long knob but does not have a gear mesh structure, it cannot be fit and used to the shooter, thus it is difficult for the launcher top and the finger top to be redirected to each other.

Furthermore, Korean Utility Model Registration No. 20-0261196 (Jan. 19, 2002) discloses a string top which is easily disassembled such that a spinning spindle can be easily replaced when being worn down and which can keep a balance by relieving the shock at the time of crash onto the ground since having an elastic buffering structure by a spring, thereby enabling even an unskilled person to spin the top easily.

However, the string top which spins by the string wound on the top has a large volume exceeding 3 cm and includes a hanger part to which the spring is inserted and on which the string is wound. So, the string top is utterly different from the finger top in concept, increases manufacturing costs due to the complicated structure of a bundle of spinning spindles for fixing the spring, and it is difficult to fit a coupling protrusion of the body to an outer ring at the time of assembly.

Meanwhile, because the spinning spindle of the launcher top is fixed rigidly, when the top collides against the ground initially after launching, a strong shock is not absorbed and is directly transmitted to the top as it is. Therefore, the top is out of the balance and does not frequently well, so the user has to repeat a launching action several times.

In connection with the above, a conventional art in which a spindle moves elastically by a spring so as to absorb the shock. However, the conventional art cannot solve the above-mentioned demerits other than the above.

Additionally, there is a method of launching a top by separating the top from a launcher. According to the method, when a user pulls the launcher after fitting and fixing the top to the launcher, the toy top is separated from the launcher by a centrifugal force generated when the top rotates. However, if the top is fixed too tightly, the top is not separated easily. On the contrary, if the top is fixed loosely, the top is easily separated from the launcher due to weak fixation power before launching. Moreover, in this case, even though the top is fixed, due to looseness, the top cannot obtain a strong spinning power, so it reduces fun and it is tiresome and complicated since the user has to launch the top several times.

Furthermore, most of launcher tops, which adopt the method of fixing a top on a launcher, have a hook-type retaining jaw. Because most of the launcher tops are made of synthetic resin, the retaining jaw is worn down when being used for a long time, and it causes deterioration of retaining power and reduction of lifespan of the top.

Additionally, because the conventional top is a single type top that only one top is fit to one launcher, the launcher top is very monotonous, and the top launched can spin jus in one direction. So, the conventional launcher top has a limitation that it cannot provide fun of various and changeable games.

Moreover, because the conventional tops are manufactured in a state where the center of gravity is settled according to standards, users cannot increase or decrease the center of gravity as the user please. That is, because the users cannot adjust the width of precession as the users want, the conventional tops has a limitation in realizing an attacking style top suitable for user preferences.

Furthermore, because the rack gear of the conventional launcher is formed at one side, the rack gear has directivity, so users feel inconvenient since they have to fit the top to a launcher body while checking all parts.

OBJECT AND SUMMARY OF INVENTION

Technical Problem

Accordingly, the present invention has been made in an effort to solve the above-mentioned problems occurring in the prior arts, and it is an object of the present invention to provide a prefabricated tuned top and a launcher for launching the tuned top, which: can be simply manufactured in a small size with only the five components of a knob, a rim, beads, a body and a spinning spindle; can be very easily assembled just by sequentially inserting and tightening the components; can implement a changeable spinning form by inducing a change in the difference between centripetal force and centrifugal force, which are generated during spinning, since the center of gravity can be eccentrically disposed freely according to the selection of a user; is prevented from being reversely loosened so that the user can safely, semi-permanently, and easily enjoy the top for pleasure at any location; and is accurately and stably mounted on the launcher not to be easily separated from the launcher, but is quickly launched from the launcher without a launch failure when the top is launched from the launcher, so as to be accurately launched without any loss of spinning power.

Advantageous Effects

The present invention can obtain the following effects.

First, the top according to the present invention can be used as a prefabricated tuned top capable of being spined by a finger since being simply manufactured in a small size with only the five components of a knob, a rim, beads, a body and a spinning spindle and being very easily assembled just by sequentially inserting and tightening the components.

Second, the present invention can implement a changeable spinning form by inducing a change in the difference between centripetal force and centrifugal force, which are generated during spinning, since the center of gravity can be eccentrically disposed freely according to the selection of a user.

Third, the present invention is prevented from being reversely loosened so that the user can safely, semi-permanently, and easily enjoy the top for pleasure at any location.

Fourth, the present invention can prevent the spinning spindle from stabbing the floor and prevent diminishment of an initial spinning power of the top by absorbing the shock at the time of initial launching since the top has a spring embedded therein to buffer the spindle of the top.

Fifth, the present invention can provide tops with various shapes, such as attacking-type tops, defensive-type tops, spinning power increasing type tops, and other type tops, since the rim of the top has various shapes.

Sixth, the present invention does not have the retaining jaw of the hook shape of the conventional top since the spindle of the top engages with the launcher in such a way as to be separated only when the user completely pulls the launcher, thereby preventing unintended separation or bad separation of the top and making correct and accurate launch possible.

Seventh, the present invention makes tuning of the top possible since the user can freely change the center of gravity of the top as the user pleases, and makes various top-spinning games of different spinning speed and movements possible since the present invention induces spinning of the top with various forms so as to change forms of precession, thereby providing further fun and enjoyment.

Eighth, the present invention has no limitation in fitting the launcher to the launcher body since rack gears are formed at both sides of the launcher to remove directivity, thereby remarkably improving user convenience.

Ninth, the present invention can realize different and changeable top-spinning games with different spinning directions and can launch a lot of tops at once while holding two or more launchers since a plurality of tops are mounted on one launcher body and one or more launchers are arranged at each side.

BRIEF DESCRIPTION OF THE DRAWINGS

FIGS. 15 and 16 are exemplary views showing use examples of the tuned top and the single type launcher illustrated in FIGS. 10 and 11;

FIG. 17 is an exemplary view of a launcher according to a modification of the present invention.

DETAILED DESCRIPTION OF THE EMBODIMENTS

Figure 1:
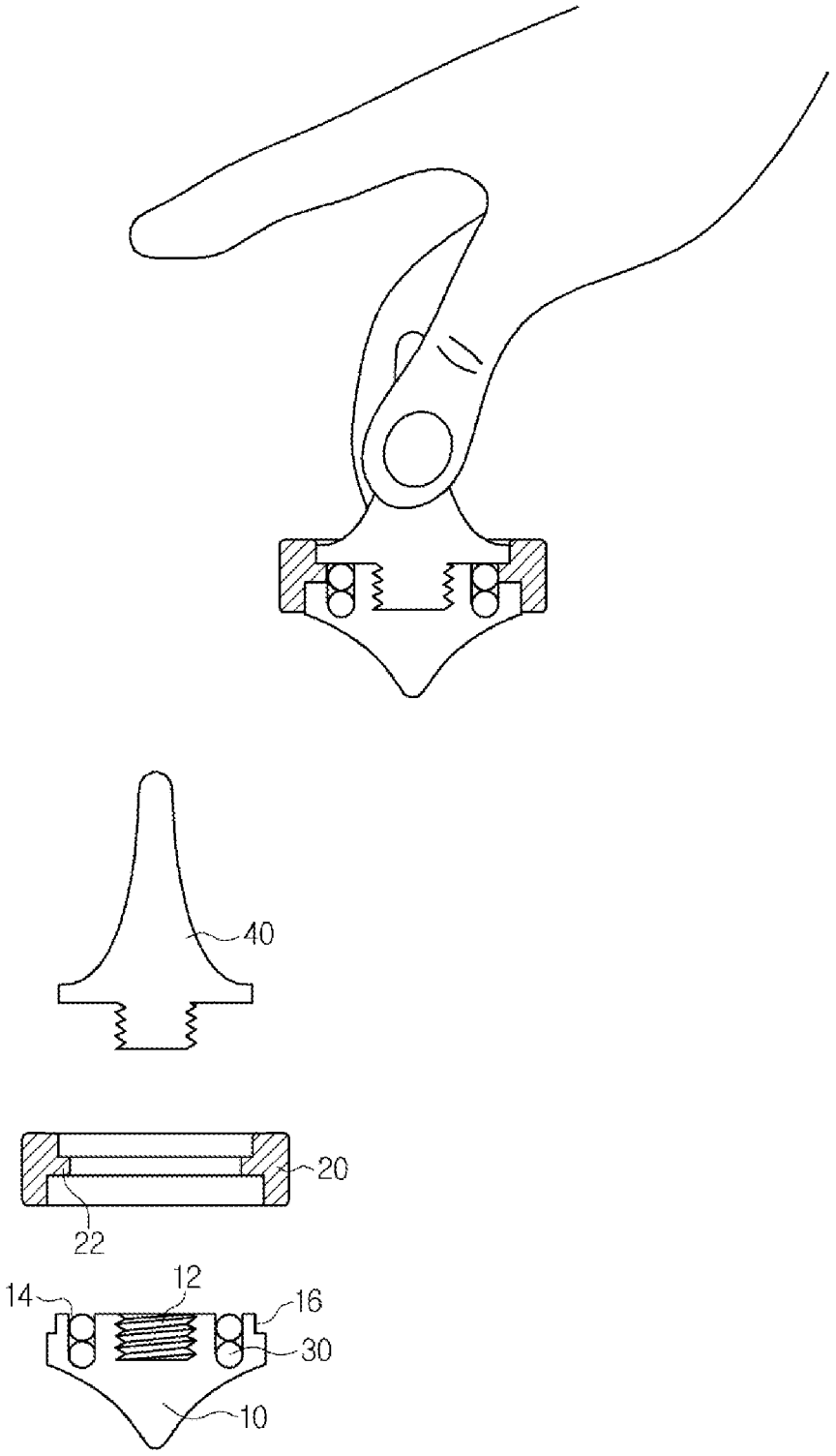
FIG. 1 is an exploded sectional view showing a prefabricated tuned top which can spin by fingers according to an embodiment of the present invention.

Hereinafter, reference will be now made in detail to the preferred embodiment of the present invention with reference to the attached drawings.

The particular structures or the functional explanations are suggested only for the purpose of explaining the embodiment depending on the concept of present invention and the embodiments according to the concept of present invention can be performed in various patterns and it shall not be interpreted to be limited to the embodiments explained in this specification or the application.

The particular embodiments are listed as examples on the drawing and they are explained in this specification and application in detail because the diversified modifications can be made on the embodiments for the concept of present invention and they can take in various patterns. However, the embodiments for the concept of present invention are not to be limited to a certain disclosure pattern and it shall be understood to include every change, equivalencies and the alternatives which are included in the range of the idea and technology of present invention.

As illustrated in FIG. 1, the prefabricated tuned top capable of spinning by fingers according to an embodiment of the present invention includes: a body 10 having a spinning spindle disposed integratedly; a rim 20 put on an upper end of the body 10 to be retained; a plurality of iron beads 30 stored in the body 10 in a single layer or multiple layers or in a single row or multiple rows and varying the center of gravity according to arrangement forms that the iron beads are stored in the body 10; and a knob 40 screw-coupled to the body 10 to prevent separation of the iron beads 30 and to fix the rim 20 by pressing the rim 20.

In this instance, the body 10 has the shape of a typical top like an upturned cone, and has a screw groove 12 of a predetermined radius formed at the center thereof to be hollowed to a predetermined depth.

Moreover, an iron bead groove 14 is formed away from the screw groove 12 to have a radius larger than that of the screw groove 12 and to be hollowed to a predetermined depth.

Furthermore, the body 10 has a stepped jaw 16 of a '⊔' shape formed on the upper end circumference thereof.

Additionally, the iron bead groove 14 is adjustable in depth so that the iron beads 30 inserted into the iron bead groove 14 can be arranged in a single layer or in multiple layers.

Figure 2:
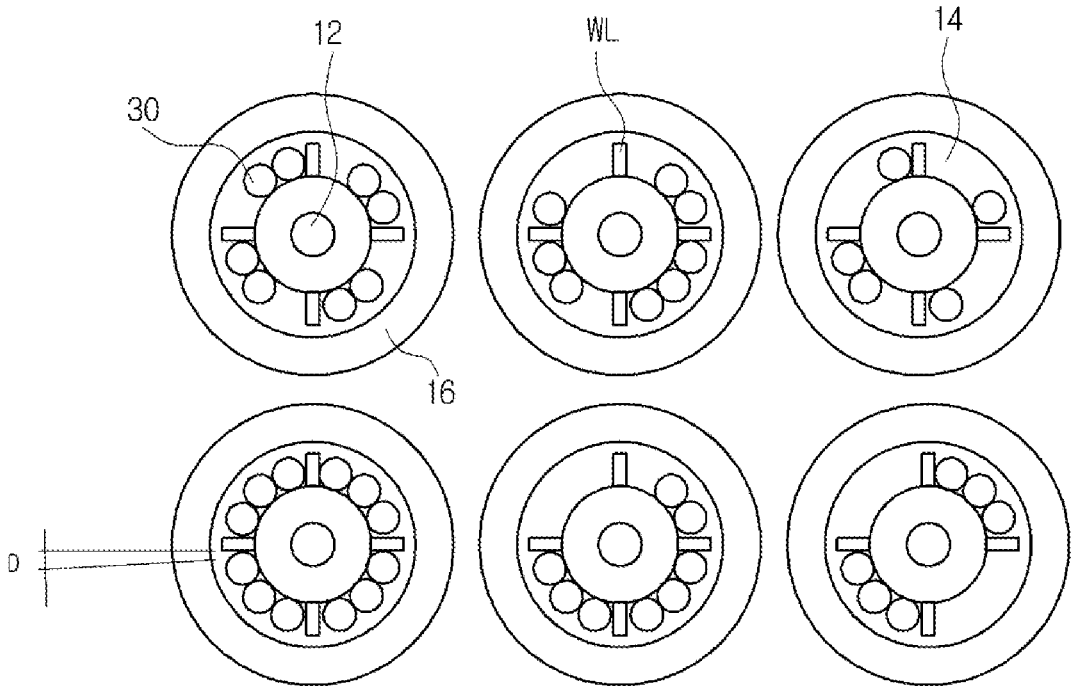
FIG. 2 is a plan view of a body showing an arrangement example of iron beads of the prefabricated tuned top which can spin by fingers illustrated in FIG. 1.

In addition, as shown in FIG. 2, the iron bead groove 14 has a plurality of partition walls WL formed in a circumferential direction so that the iron beads 30 can be arranged in various forms to make the center of gravity eccentric by putting and removing the iron beads 30. So, the top according to the present invention can be changed into a miniaturized finger top with an increased attacking power and desired attacking patterns by adjusting the spinning power of the finger top and intensity of precession.

In other words, when the iron beads 30 are arranged asymmetrically, the top is changed into an attacking-type finger top while rolling from side to side due to a weakened centripetal force.

Therefore, the top generates various centripetal forces and centrifugal forces according to the arrangement forms of the iron beads 30 so as to amplify the fun of changeable games, and increases spinning power when the number of the iron beads 30 is increased.

Especially, when a gap is formed in a space where the iron beads 30 are arranged, it increases centrifugal force, so that the spinning power of the finger top can be increased more.

So, besides the single-layered arrangement or the multiple-layered arrangement of the iron beads 30 described above, it is natural that the iron beads can be arranged in a single row, in two rows or in multiple rows when the size of the iron bead groove 14 and the caliber of the iron beads 30 are adjusted.

As described above, the iron beads 30 are mounted for the purpose of tuning to increase spinning power (centrifugal force+centripetal force), and it has been confirmed that there is no example that such a concept is applied to the conventional finger tops.

Moreover, the rim 20 is the part that the finger top is crashed into another top while spinning. The rim 20 is put on the stepped jaw 16 of the body 10 to be retained, so forms the outward appearance of the circumference of the finger top.

The rim 20 has a retaining jaw 22 protruding from the inner diameter, and the retaining jaw 22 is stably put on the stepped jaw 16 in a retained state when the rim 20 is assembled to the body 10.

Figure 3:
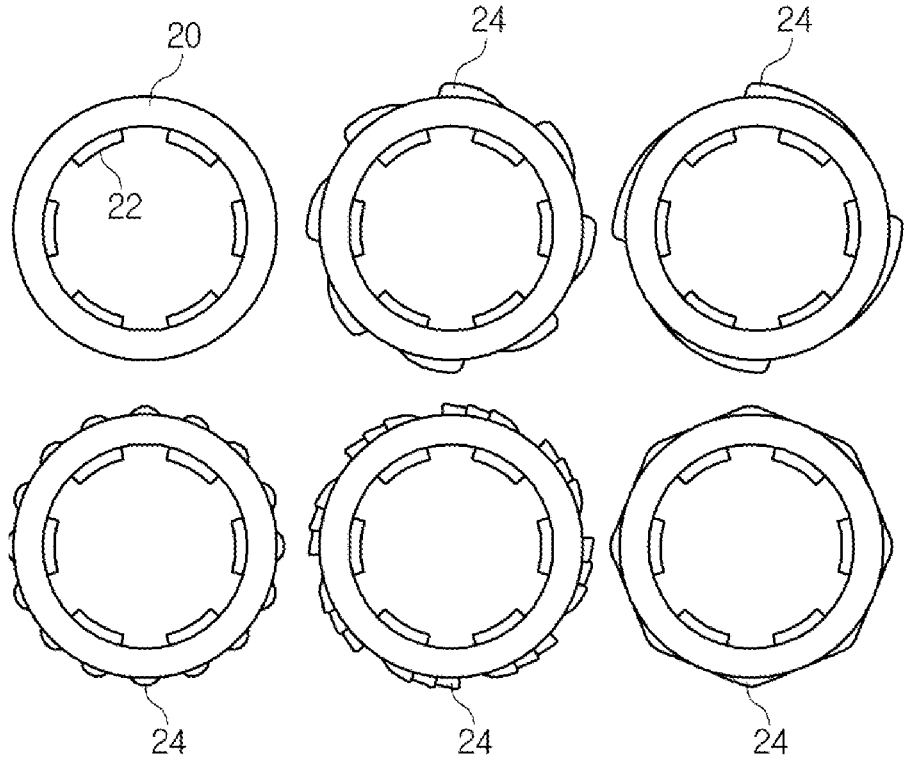
FIG. 3 is a plan view of a rim of the prefabricated tuned top which can spin by fingers illustrated in FIG. 1.
Figure 4A:
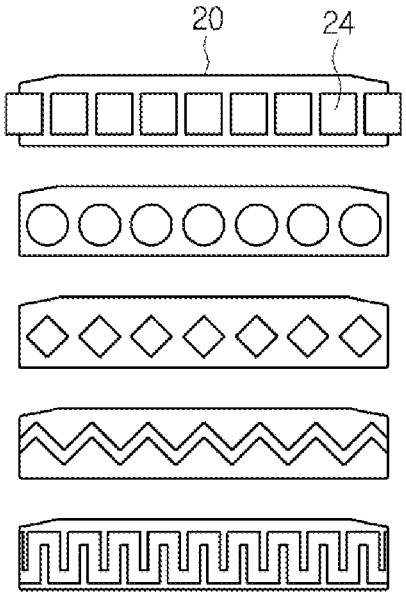
FIG. 4 is an exemplary view showing various shapes of outer circumferential surface of the rim according to various modifications of the prefabricated tuned top.
Figure 4C:
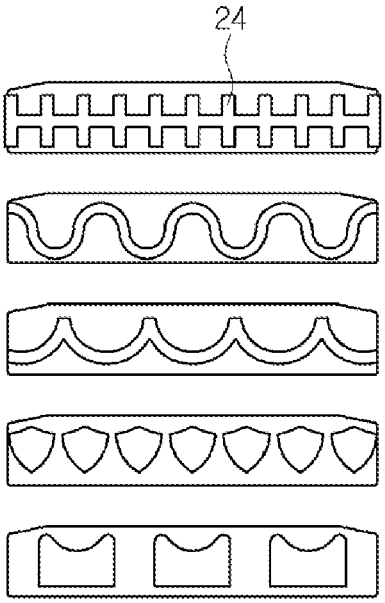
Figure 4B:
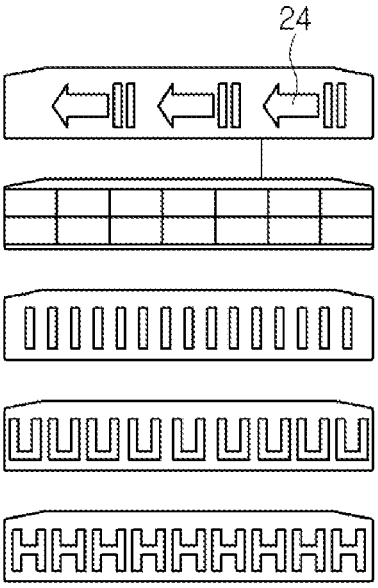
Figure 4D:
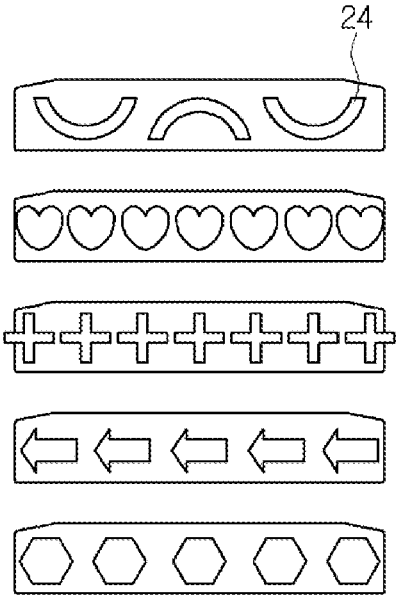

Additionally, the rim 20 has crash form portions 24 of various shapes protruding from the outer circumference of the rim 20 as illustrated in FIG. 3, so as to realize a customized finger top appropriate for attack and defense.

In this instance, the rim 20 may be manufactured of synthetic resin or metal.

Moreover, as shown in FIGS. 4(*a*), (*b*), (*c*) and (*d*), the crash form portions may have various shapes, and may have other various shapes besides the shapes illustrated in FIGS. 4(*a*), (*b*), (*c*) and (*d*).

The crash form portions 24 may be embossed, engraved, or formed in combination of embossment and engraving, and of course, the shapes illustrated in FIG. 4 may be embossed, engraved, or formed in combination of embossment and engraving.

In the meantime, because the knob 40 is fixed to the screw groove 12 of the body 10 in a screw coupling manner, when the spinning direction is designed to be in a locking direction, because the top always receives power in the locking direction while spinning, there is no looseness caused by loosening of the screw like fan blades.

Nevertheless, the knob 40 may be loosened by receiving power in a loosening direction while being carried or stored or due to other various reasons.

Because the above may have an influence on spinning power of the finger top, the present invention further includes a reverse loosening prevention structure.

Figure 5:
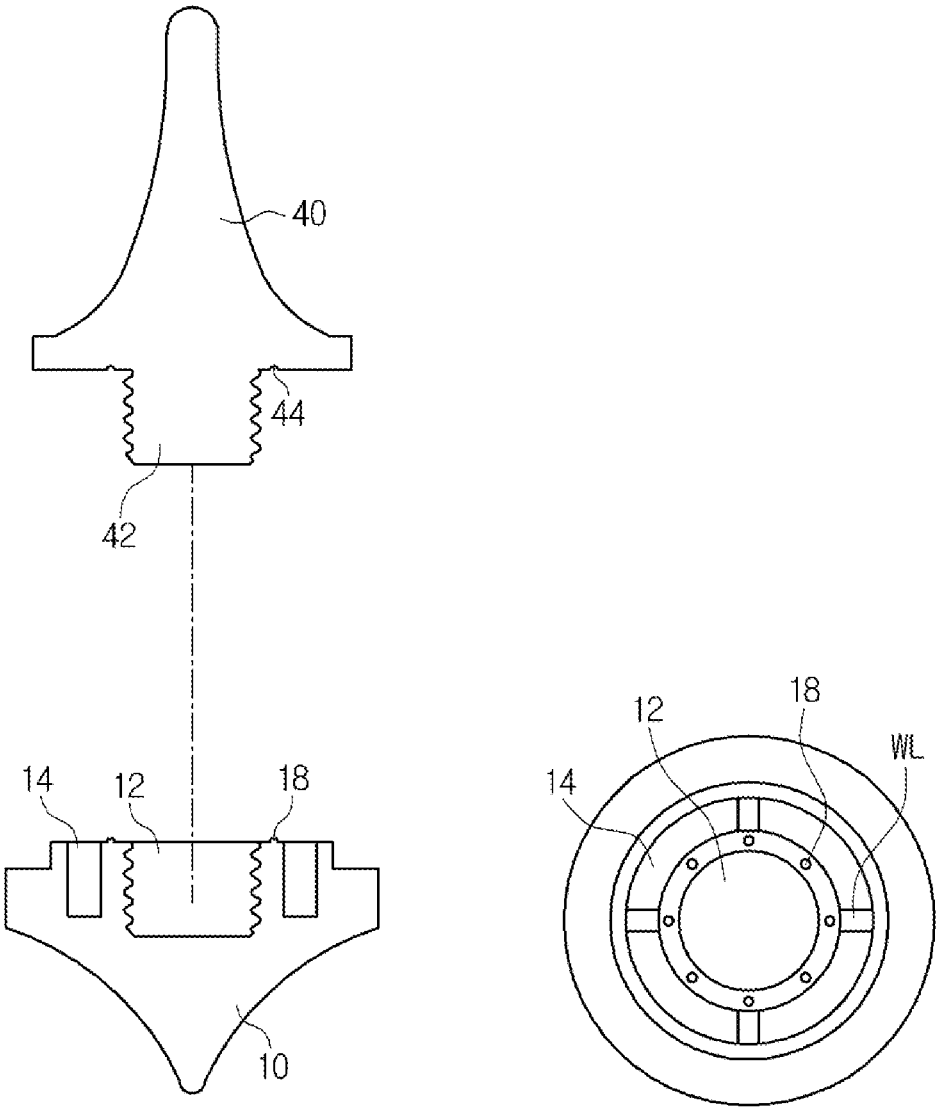
FIG. 5 is an exemplary view showing a reverse loosening prevention structure between a body and a knob of the prefabricated tuned top.

For instance, as shown in FIG. 5, a plurality of semicircular protrusions 18 protruding from the surface between the screw groove 12 and the iron bead groove 14 of the body 10 in the circumferential direction to be spaced apart at predetermined intervals. The knob 40 further includes a coupling portion 42 formed at a portion of the bottom surface thereof corresponding to the screw groove 12 to be screwed to the screw groove 12, and a reverse loosening prevention groove 44 of a semicircular shape in which the semicircular protrusions 18 are inserted.

So, when the knob 40 is coupled to the body 10 completely, because the semicircular protrusions 18 are inserted and caught into the reverse loosening prevention groove 44, reverse loosening is restricted if a great external force is not applied.

Therefore, the user can carry and store the top in safety.

Furthermore, it is not essential that the knob 40 has the illustrated shape, and it is good that the knob has the shape that user can easily grip it with the fingers to realize the finger top.

However, the height that the rim 20 protrudes from the surface after assembly must be larger than the length of the body 10 from the bottom end to the surface of the rim 20, so as to make a sufficient grip possible and to generate stable and accurate spinning power.

Figure 6:
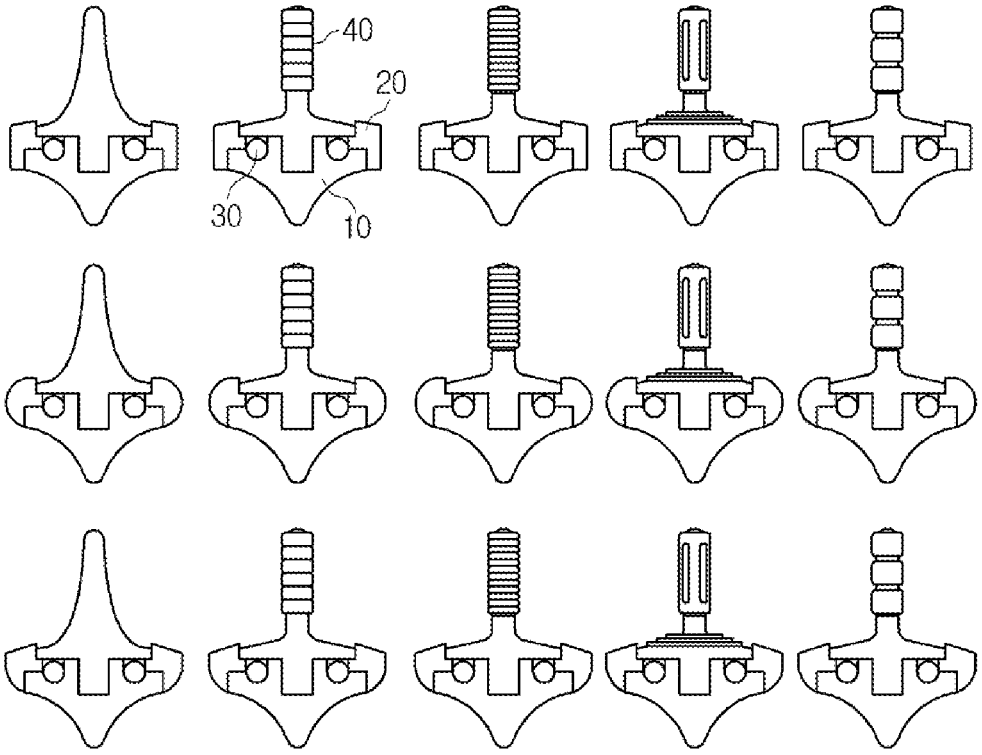
FIG. 6 is an exemplary view showing various shapes of the prefabricated tuned top which can spin by fingers according to various modifications of the present invention.

FIG. 6 shows various outward appearances of the finger top.

Especially, FIG. 6 shows various modifications of the finger top 40 and modifiable forms of the rim 20.

Additionally, FIG. 6 illustrates that the iron beads 30 are arranged in a single layer and in one row.

The knob 40 is a part that the user grips with two fingers including the thumb. When the user gives torsional moment instantaneously while gripping the knob 40, the finger top spins while the spinning spindle is converted by spinning power (centrifugal force+centripetal force).

According to the principle, various shapes and forms of the knob 40 have an influence in generating weak or strong torque, and serve to adjust the spinning power (centrifugal force+centripetal force) of the finger top.

Figure 8:
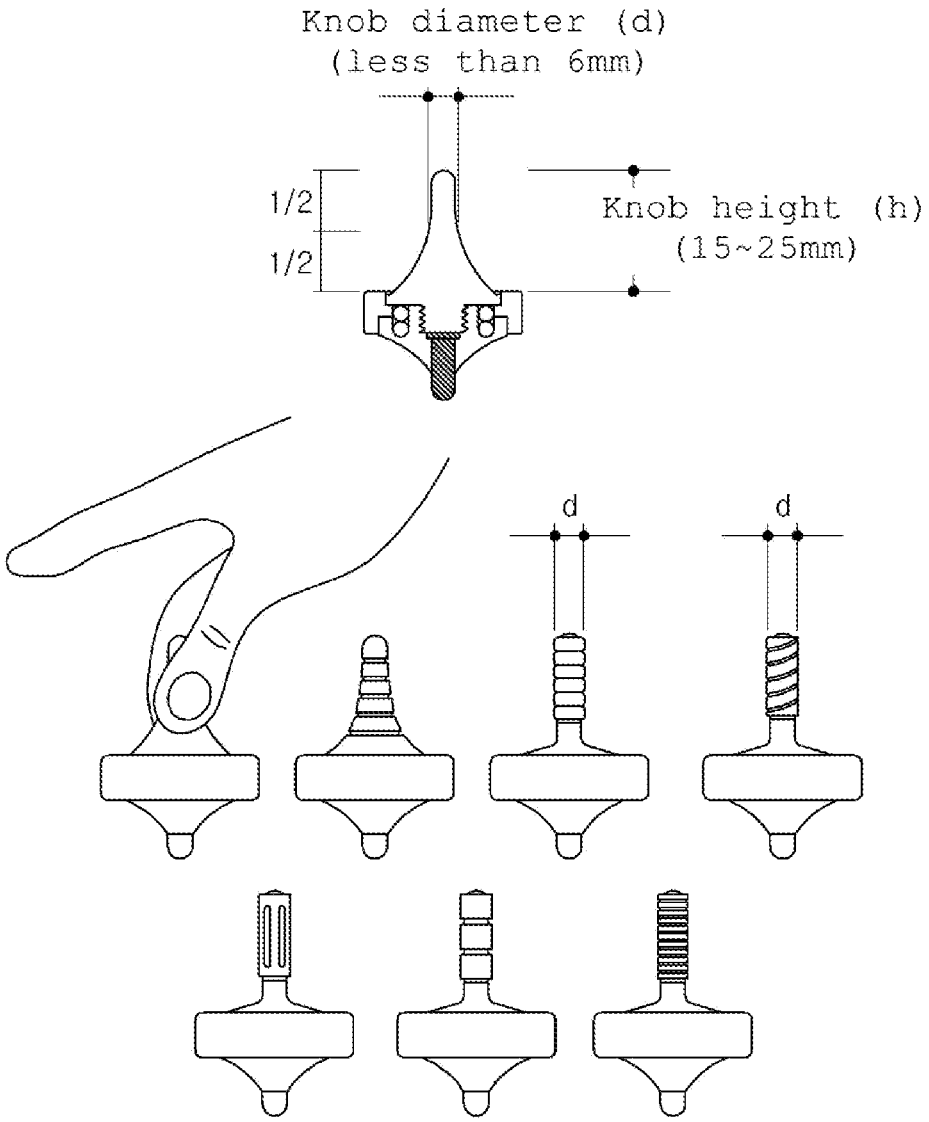
FIGS. 8 and 9 are exemplary views showing various shapes of the prefabricated tuned top which can spin by fingers illustrated in FIG. 7.

Preferably, the diameter of the knob 40 which is the part that the user grips with two fingers including the thumb is less than 6 mm as illustrated in FIG. 8, but it is not limited to the above.

In addition, the height of the knob 40 is within the range of 15 to 25 mm so that the user can turn the top with the fingers, but it is not limited to the above. As described above, the knob 40 must have a proper height. If the knob 40 is too long, it may hinder spinning, and if the knob 40 is too short, it cannot generate proper spinning power.

In addition, FIG. 6 is just a part of various modifications of the present invention, and the present invention can be varied within the range of the technical idea of the present invention.

Figure 7:
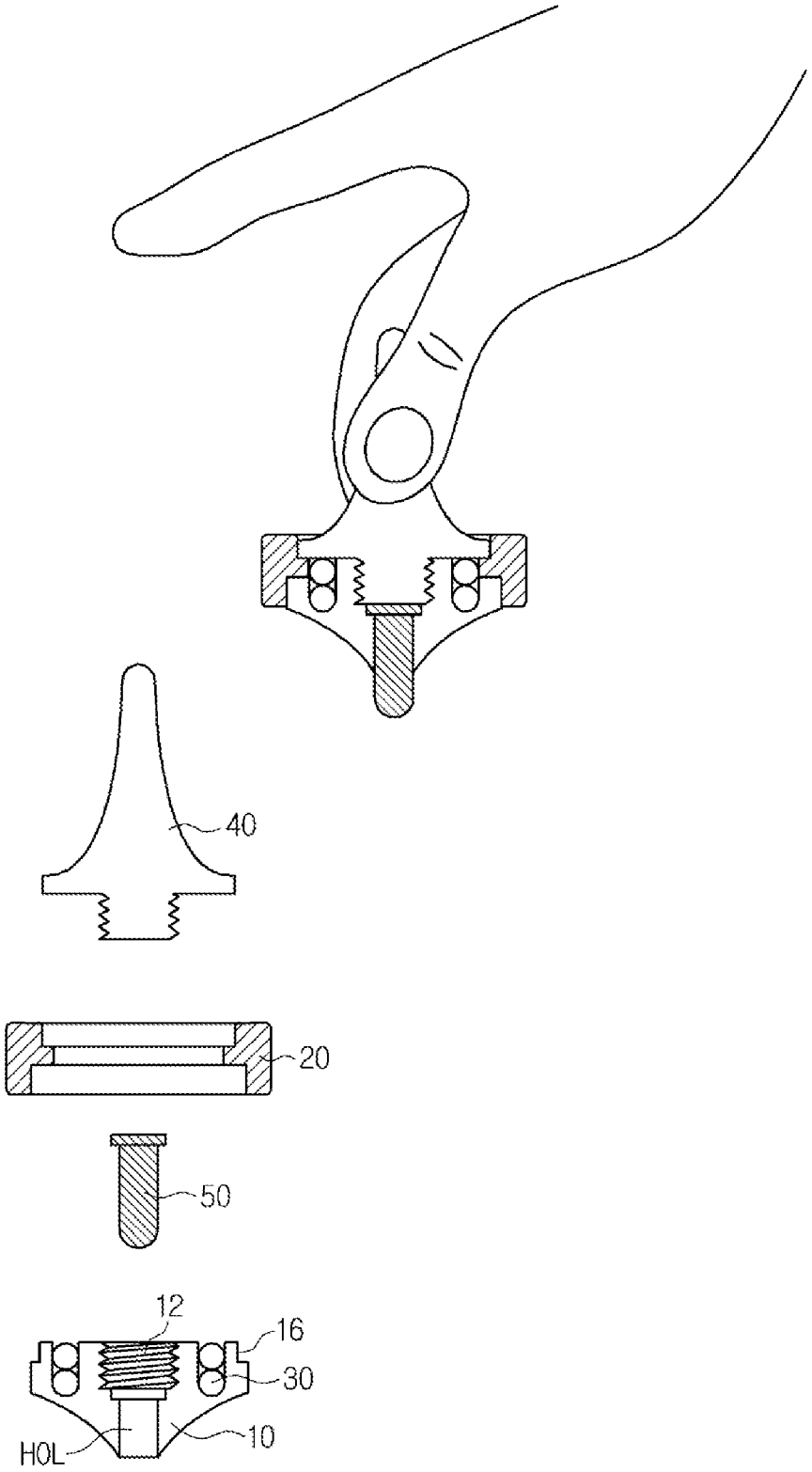
FIG. 7 is an exploded sectional view showing a prefabricated tuned top which can spin by fingers according to another embodiment of the present invention.

FIG. 7 illustrates a prefabricated tuned top spined by the fingers according to another embodiment of the present invention. As illustrated in FIG. 7, the refabricated tuned top spined by the fingers includes: a body 10; a rim 20 put on an upper end of the body 10 to be retained to the body 10; a plurality of iron beads 30 stored in the body 10 in a single layer or multiple layers or in a single row or multiple rows and varying the center of gravity according to arrangement forms of the iron beads stored in the body 10; a knob 40 screw-coupled to the body 10 to prevent the iron beads 30 from being separated and to press and fix the rim 20; and a spinning spindle 50 mounted in such a way that a lower portion is exposed after penetrating through the body 10 to be pressed and fixed by the bottom surface of the knob 40.

In this instance, the body 10, the rim 20, the iron beads 30, and the knob 40 are in the same category as the first embodiment described above.

The top according to the second embodiment of the present invention includes all of the parts of the first embodiment as they are.

However, some parts of the body 10 are transformed in order to mount the spinning spindle 50, and the transformed parts will be described.

That is, a spindle hole HOL is formed from an upper end to a bottom end at the center of the body 10, namely the center of a screw groove 12. The spindle hole HOL has a structure that a large diameter and a small diameter are formed from the upper end to the bottom end to communicate with each other to have a stepped portion therebetween.

Therefore, a T-shaped spinning spindle 50 is assembled to be retained and fixed to the spindle hole HOL after being inserted into the spindle hole HOL.

Then, a portion of the bottom end of the spinning spindle 50 is exposed to a lower portion of the body 10 after penetrating through the spindle hole HOL to serve as a rotary axis on the bottom surface. The knob 40 gets in contact with the upper end of the spinning spindle 50 to fix the spinning spindle 50 not to be moved.

Figure 9:
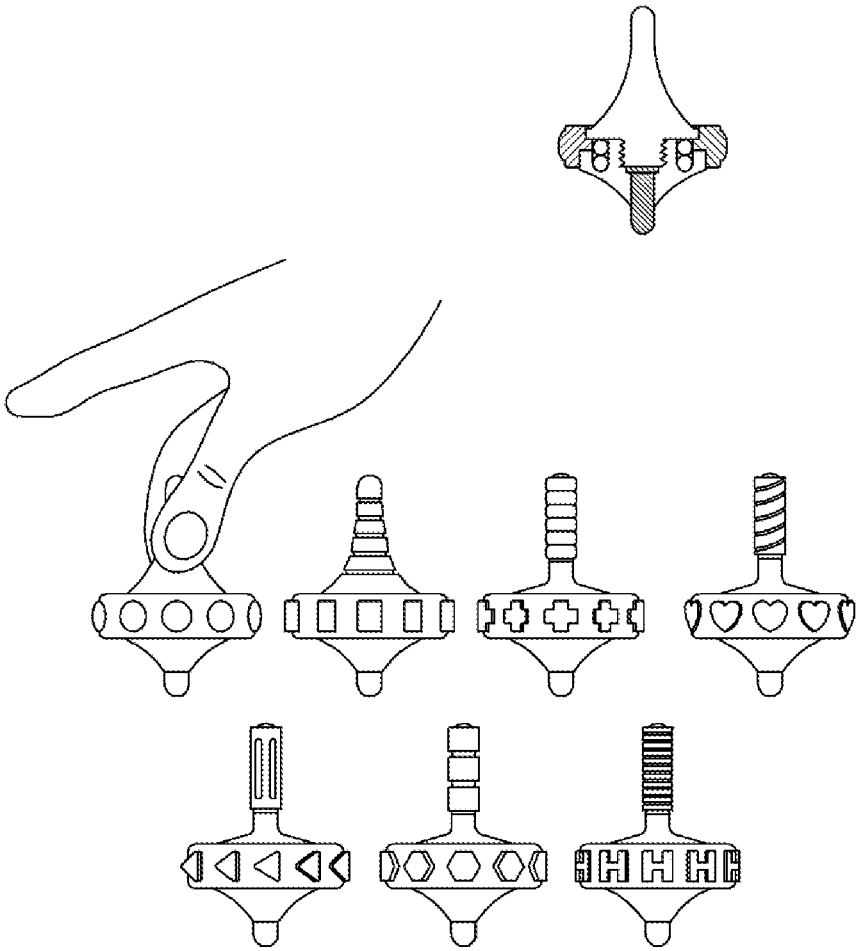

The finger top according to the second embodiment of the present invention may be modified in various ways as shown in FIGS. 8 and 9 so as to provide various esthetic senses and functions.

Especially, referring to FIG. 8, the description of the structure of the knob 50 will quote description of the first embodiment.

Figure 10:
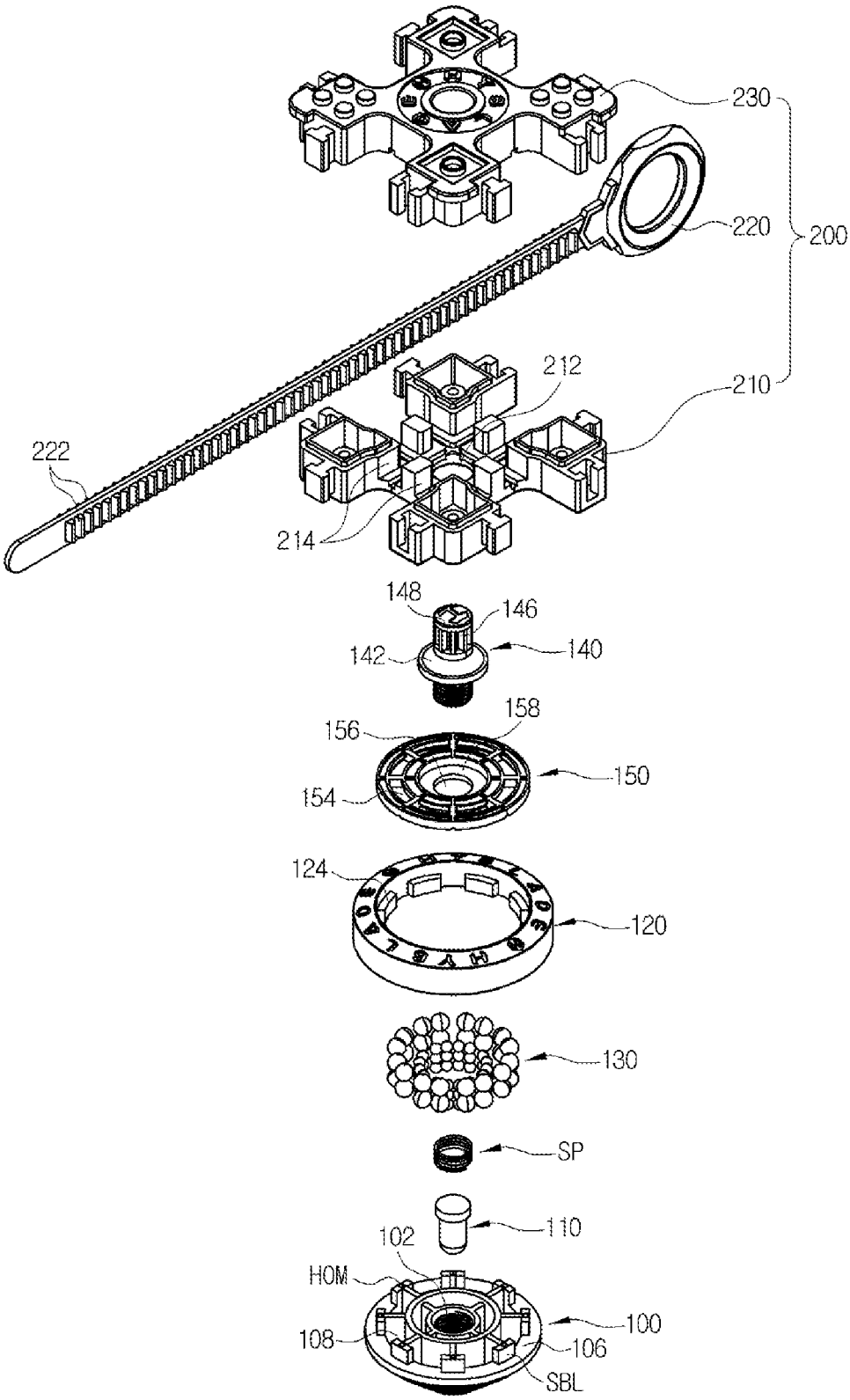
FIGS. 10 and 12 are exploded perspective views showing a prefabricated tuned top for a launcher and a launcher of the FIGS. 10 and 11 are exploded perspective views showing a prefabricated tuned top and a launcher of the tuned top according to a further embodiment of the present invention.
Figure 11:
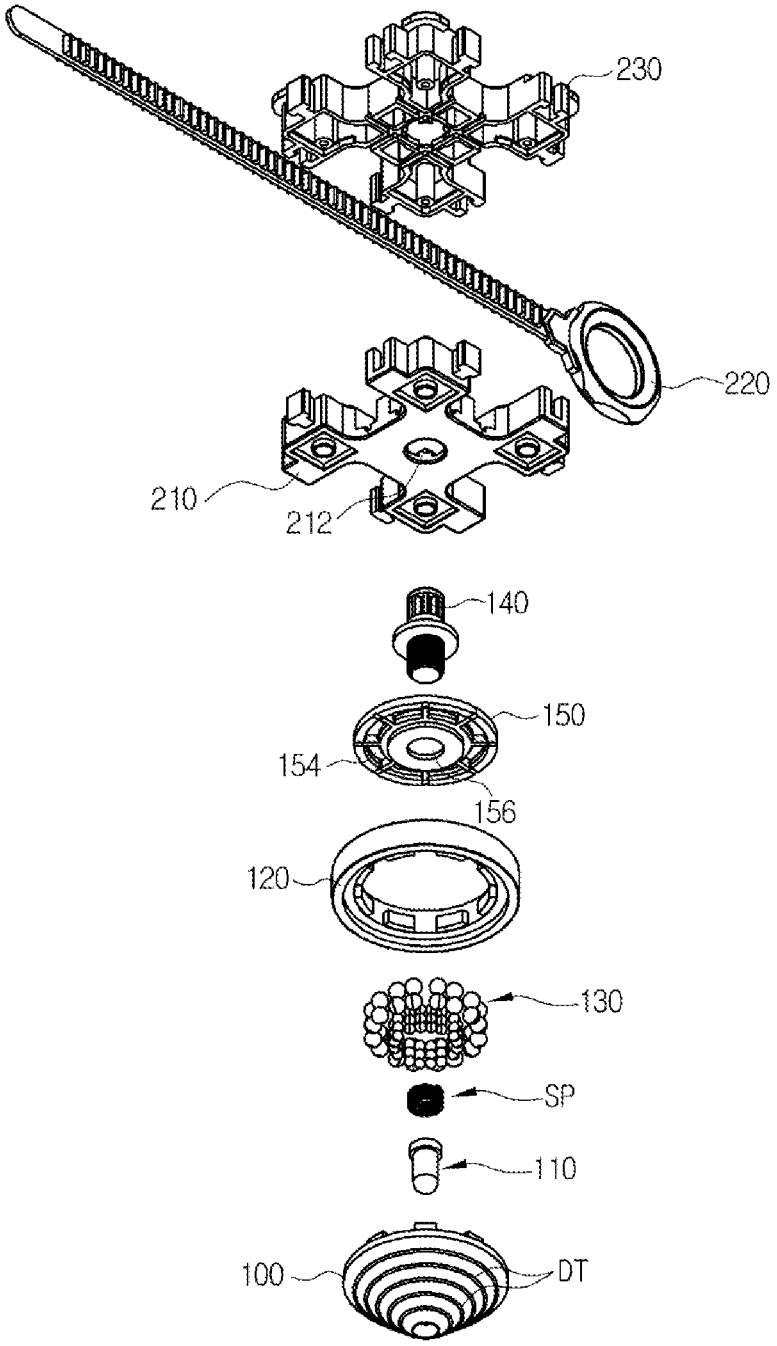
Figure 12:
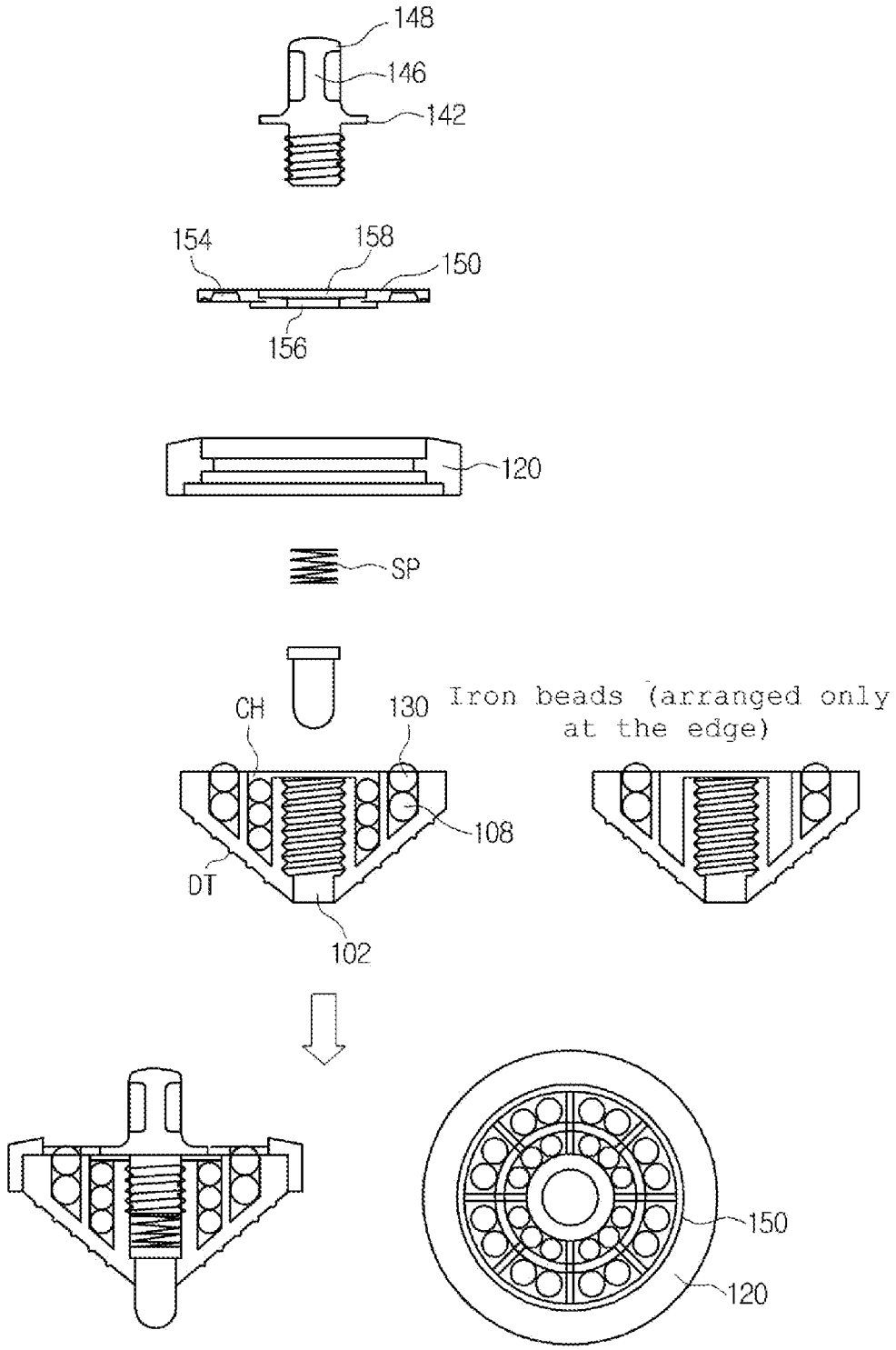

In the meantime, a prefabricated tuned top capable of spinning by a launcher may have the form illustrated in FIGS. 10 to 12 so as to be combined with the launcher.

As shown in FIGS. 10 to 12, the launcher 200 includes: a lower base 210 having a knob insertion hole 212 formed at the center and winder insertion grooves 214 formed at one side or both sides in such a way that the knob insertion hole 212 is interposed therebetween; an upper base 230 matching the lower base 210 to be opposed to the lower base 210; and a winder 220 fit into the winder insertion groove 214.

In this instance, the winder 220 is a plate-shaped band having rack gears 222 formed at both sides thereof.

Moreover, a body 100 of the prefabricated tuned top for a launcher has a spindle hole 102 formed at the center of the body 10 to vertically penetrate through the center of the body 100.

In this instance, the spindle hole 102 has a structure that a large diameter and a small diameter are formed from the upper end to the bottom end to communicate with each other while having a stepped portion therebetween.

Furthermore, the body 100 further includes protrusion jaws DT (see FIG. 11) somewhat protruding from the circumference of a truncated cone part to be vertically spaced apart from one another at intervals so that a string can be easily wound on the top without a slip. Therefore, the prefabricated tuned top for a launcher can be used as a string top.

Additionally, an iron bead groove 108 having a diameter larger than that of the spindle hole 102 is formed in a concentric circle with the spindle hole 102.

Figure 13:
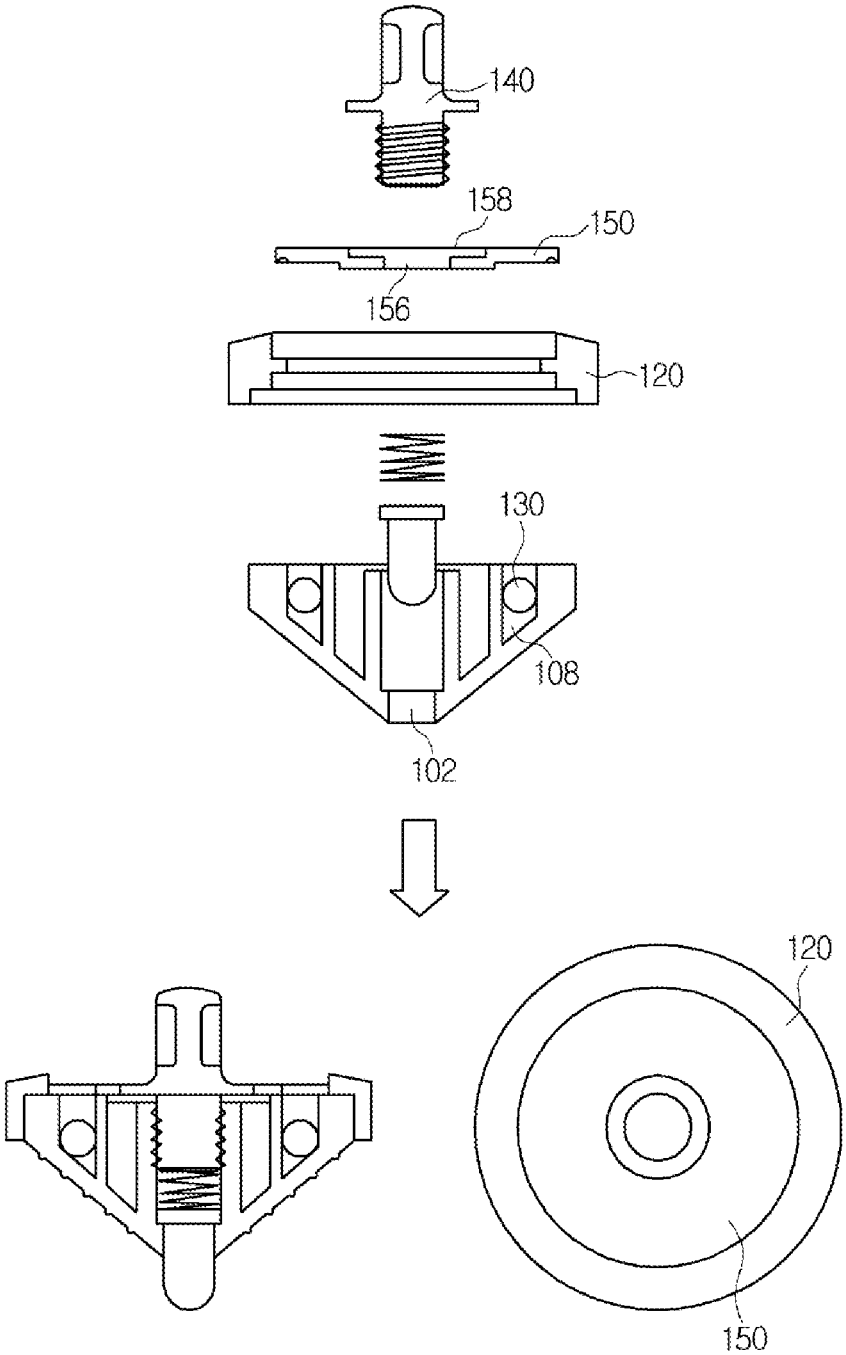
FIGS. 13 and 14 are mimetic diagrams for showing the structure of the tuned top illustrated in FIGS. 10 and 11.

In this instance, as shown in FIG. 12, because the iron beads 130 which are somewhat inserted into the iron bead groove 108 are caught to upper ends of the iron bead groove 108, the iron beads 130 are shown through the cover 150. As shown in FIG. 13, it is also possible that the iron beads 150 are completely inserted into the iron bead groove 108 so that they are completely sealed by the cover 150 not to be shown to the outside when the cover 150 is combined.

Figure 14:
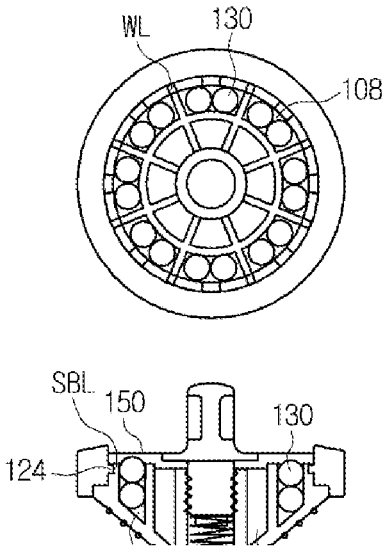

Here, as described above, the iron beads 130 may be arranged in multiple layers and in multiple rows. Especially, if the iron beads 130 are completely inserted into the iron bead groove 108 as shown in FIG. 13, in case that the iron beads 130 are arranged in two layers as illustrated in FIG. 14 to have four partition walls WL, 16 iron beads 130 are accommodated in the iron bead groove 108, and in case of having eight partition walls WL, 32 iron beads 130 to the maximum are accommodated in the iron bead groove 108.

Moreover, in case that iron bead grooves 108 are formed doubly to form a chamber CH at an inner part closer to the spindle hole 102, the iron beads 130 may be arranged in a single layer, in two layers or in multiple layers (three layers, four layers or others), and may be arranged in multiple rows by adjusting the number of the iron beads 130 by inserting and removing the iron beads 130 into or from the chamber CH and the iron bead groove 108, so as to make eccentric arrangement of various forms possible and to easily generate precession of the top.

Especially, in case that the chamber Ch and the iron bead groove 108 are partitioned by the partition walls WL, some sections of the partitioned space have the iron beads 130 and the others of the partitioned space have no iron beads 130 to be empty, so it makes eccentric arrangement of the iron beads 130 possible in various ways.

Furthermore, a plurality of stopper blocks SBL protruding upwards along the outer diameter of the iron bead groove 108 are formed on a flat surface part 106 to be spaced apart from one another at regular intervals.

Additionally, a spring SP is arranged on an upper portion of the spinning spindle 110 to elastically press the upper end of the spinning spindle 110.

In addition, the rim 120 has engaging parts 124 formed on the inner circumferential surface, and the engaging parts 124 do not protrude in a round form but have a broken shape formed in the circumferential direction. The stopper blocks SBL are fit and assembled between the engaging parts 124.

Therefore, when the rim 120 is firmly fit and engages with the stopper blocks SBL when being put on the body 100, the rim 120 is fixed at its correct position without movement. Therefore, a release preventing function of the knob 140 which will be described later can be obtained naturally.

Moreover, the rim 120 may further include various machined parts protrudingly formed on the outer circumferential surface, so that the top can be transformed to an attack-type tuned top or a defensive-type tuned top.

Furthermore, the cover 150 is inserted into the rim 120, and is arranged to get in contact with the upper surfaces of the engaging parts 124.

Additionally, the cover 150 may further include a reverse rotation preventing groove 152 formed on the circumference of the bottom surface thereof. In case that the reverse rotation preventing groove 152 is formed, in order to implement the function, reverse rotation preventing protrusions RFT of a semicircular shape are formed on the upper surfaces of the stopper blocks SBL. Therefore, by engagement between the reverse rotation preventing groove 152 and the reverse rotation preventing protrusions RFT, the knob 140 is strongly prevented from being reversely rotated and loosened when being screwed.

As described above, because the reverse rotation preventing groove 152 and the reverse rotation preventing protrusions RFT are optional, they are omitted in FIGS. 12 and 13.

In addition, the cover 150 further includes iron bead exposure holes 154 perforated in the circumferential direction at regular intervals and spaced apart from the reverse rotation preventing groove 152.

In this instance, because the iron bead exposure holes 154 are formed in a slit shape having a width smaller than a diameter of the iron beads 130, the iron beads 130 may be partially exposed but are not separated to the outside.

Moreover, the cover 150 includes a knob through hole 156 formed at the center of the circle, and a knob recess 158 which is hollowed to a predetermined depth, is formed between the knob through hole 156 and the iron bead exposure holes 154 to make a concentric circle with the knob through hole 156, and has a diameter larger than the knob through hole 156.

Furthermore, the knob 140 includes an assembly protrusion 142 formed at a lower end portion based on a knob flange 144 to be screwed to the spindle hole 102 of the body 100, a knob pinion 146 formed at an upper end portion to engage with the rack gear 222, and a retaining flange 148 formed at an upper end of the knob pinion 146.

Therefore, when the knob 140 is tightened to be screwed to the spindle hole 102, the cover 150 is rotated together. In this instance, because the reverse rotation preventing groove 152 of the cover 150 rotates and moves while engaging with the reverse rotation preventing protrusions RFT of the stopper blocks SBL, when the knob 140 is finally assembled, the knob is not easily loosened by the power that the spring SP pushes up and the engagement power between the reverse rotation preventing groove 152 and the reverse rotation preventing protrusions RFT even though external shock is applied.

That is, because reverse rotation of the knob 140 is prevented and looseness of the knob is restricted powerfully, the present invention can realize more stable top-spinning games.

Additionally, because the retaining flange 148 has a diameter smaller than that of the knob insertion hole 212 formed in the lower base 210, it is smoothly inserted into the knob insertion hole 212. Because a vertical width of the knob pinion 146 is larger than the width of the rack gear 222, when the rack gear 222 is inserted into the winder insertion groove, it can be more easily and smoothly geared with the knob pinion 146 which is inserted into the knob insertion hole 212.

Especially, because the rack gear 222 is caught to the retaining flange 148 in the state where the rack gear 222 is geared with the knob pinion 146, the rack gear 222 is not released and is not separated from the retaining flange 148 in any events.

When the winder 220 is pushed into the winder insertion groove 214 in order to launch the top in the state where the knob 140 is inserted into the knob insertion hole 212, the rack gear 222 of the winder 220 is automatically geared with the knob pinion 146 and the retaining flange 148 is caught to the winder 220 at the same time, the tuned top is never separated and keeps a stably fixed state.

In the above state, when the user pulls the winder 220, the knob pinion 146 rotates strong, and binding force of the retaining flange 148 applied to the winder 220 is released as soon as the winder 220 completely gets out of the winder insertion groove 214, the tuned top drops down while spinning at the rotational speed.

As described above, the present invention prevents a poor mounting of the tuned top through a mechanical combination by a structural change, and transmits rotary and kinetic energy of the winder 220 to the tuned top as it is, so that the user can spin the top faster and more effectively.

Figure 15:
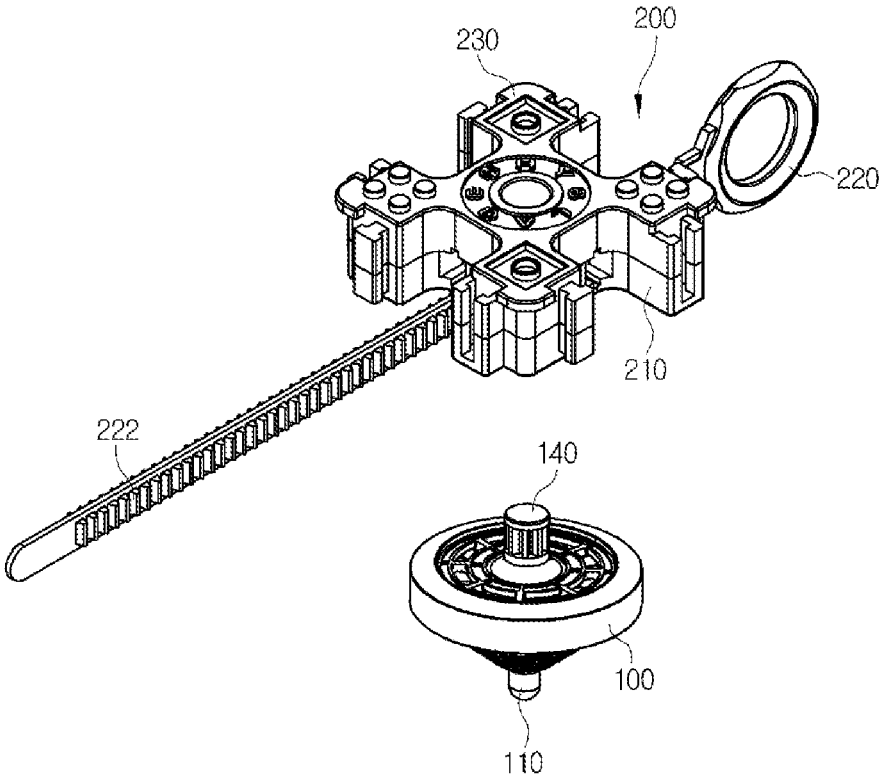
Figure 18:
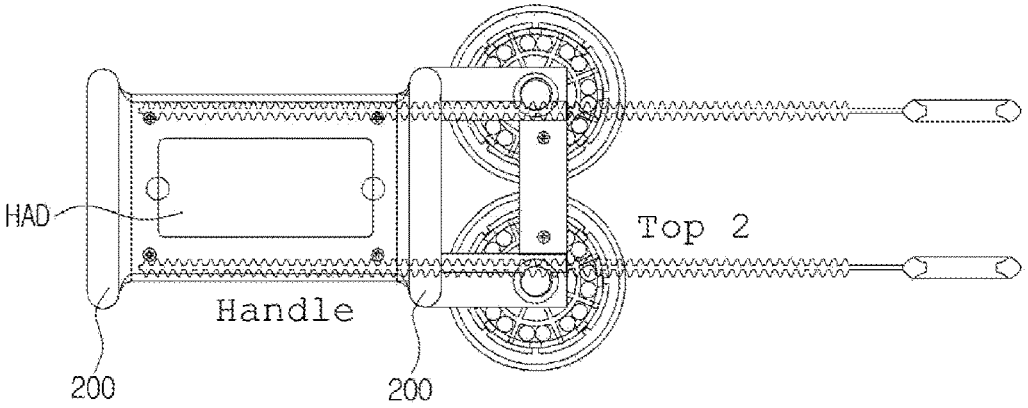
FIGS. 18 to 21 are exemplary views of a launcher according to another modification of the present invention and exemplary views showing use examples of the launcher according to the modification.
Figure 19:
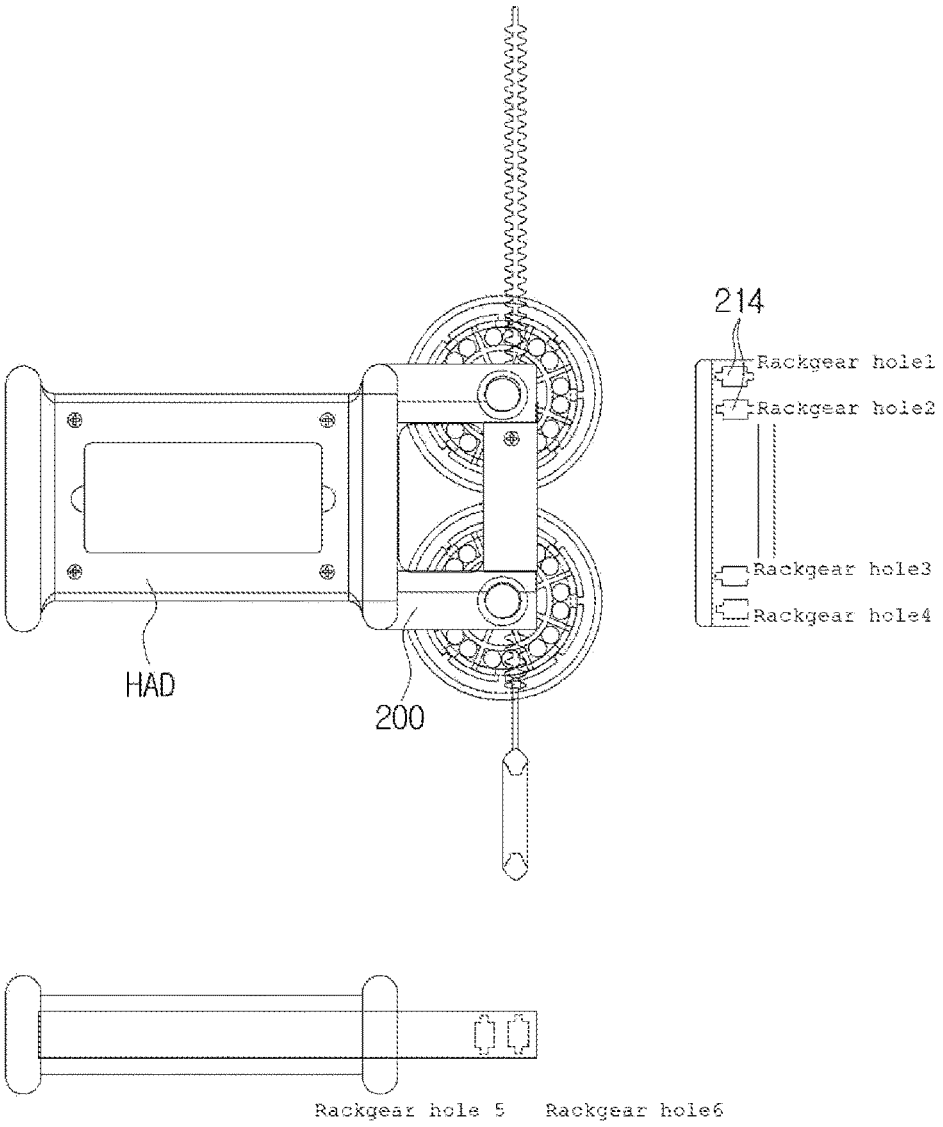
Figure 20:
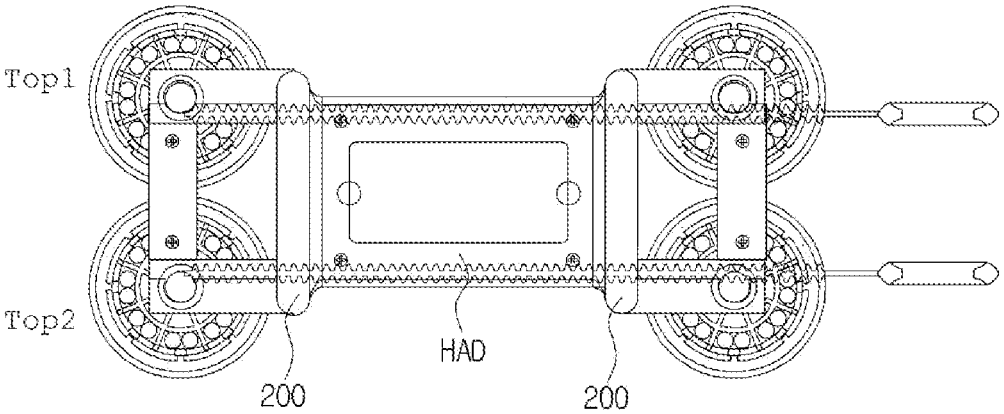
Figure 21:
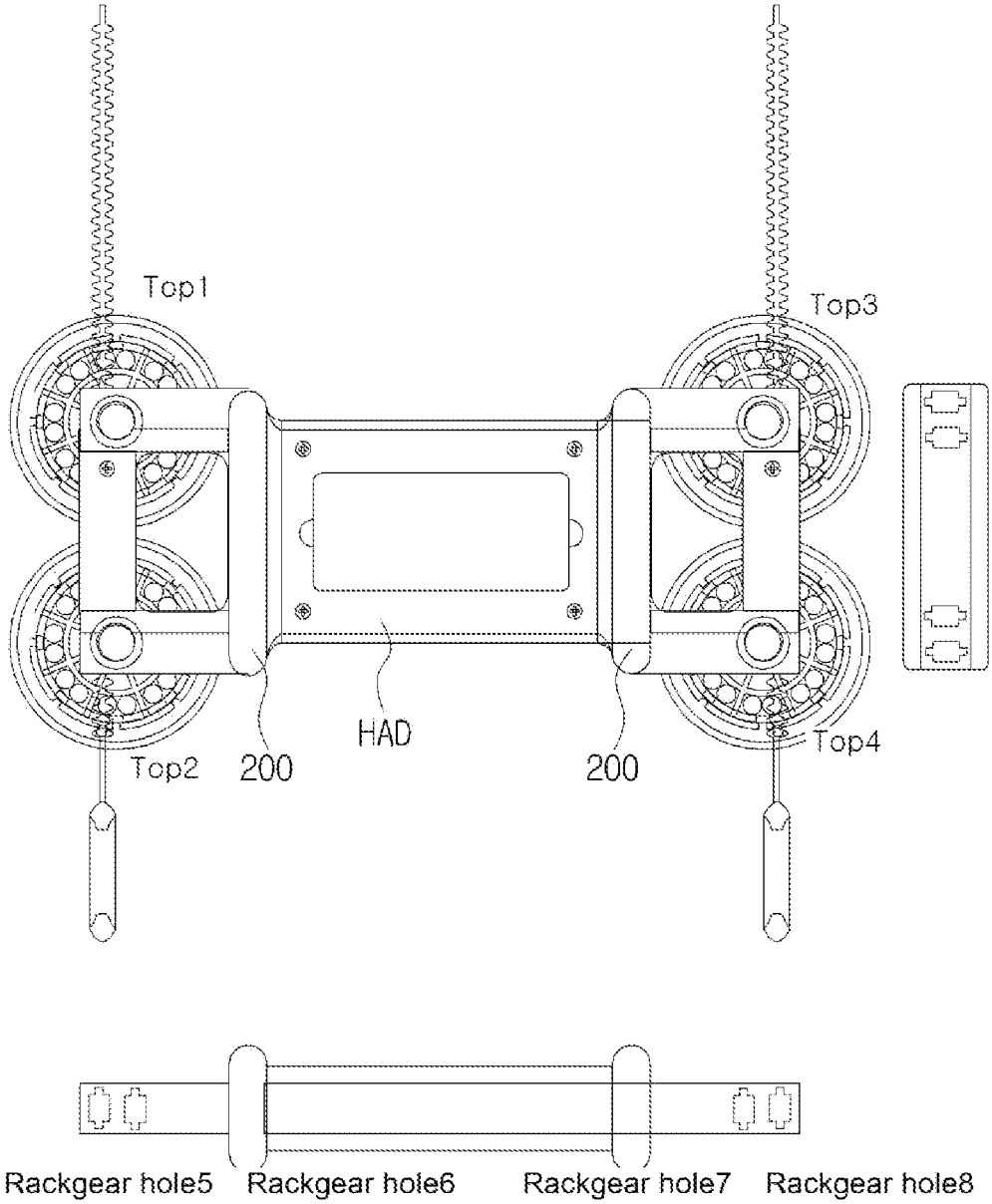

FIGS. 15 and 16 illustrate a preferred example of the tuned top.

FIG. 17 shows various modifications of the launcher 200.

Referring to FIG. 17, FIG. 17(*a*) shows an example that launchers 200 are arranged vertically, wherein the winders 220 are assembled in the opposite directions to each other so that the spinning directions of the tuned tops are opposed to each other.

Moreover, the launchers may be arranged in multiple rows as shown in FIGS. 17(*c*) and 17(*d*), or nine launchers may be connected and assembled with one another as shown in FIG. 17(*e*) in order to spin the nine tuned tops at the same time.

In the above case, the winder insertion grooves 214 are formed in four sides of the lower base 210 and the upper base 230 to make an assembled direction of the winders 220 free.

Furthermore, as shown in FIGS. 18 to 21, the launcher further includes a handle HAD so that launchers 200 can be arranged at one side or both sides of the handle HAD in multiple layers and in multiple rows so as to launch the tuned tops in various forms.

In this instance, when the tuned levels and launched directions of the tops are varied, a plurality of the tops are launched at different spinning speeds and vibrations in different spinning directions or are launched at the same time, so as to realize changeable top-spinning games that the conventional toy tops cannot realize.

Such a concept is a new concept created only by the present invention, and can provide surprising functions and fun that the conventional toy tops cannot realize.

The invention claimed is:

1. A prefabricated tuned top comprising:

a body at its center comprising a screw groove formed to a predetermined depth;

a rim positioned and retained on an upper end of the body;

a plurality of iron beads varying a center of gravity according to stored arrangement forms of the iron beads in the body;

a knob screw-coupled to the body to prevent separation of the iron beads and to fix the rim by pressing the rim onto the body; and a spinning spindle mounted such that a portion of a lower end of the spinning spindle is exposed after penetrating through the body, the spinning spindle is pressed and fixed by a bottom surface of the knob;

wherein the body comprises a spindle hole perforated from a bottom end of the screw groove through the body, the spindle hole being formed such that a diameter of an upper end of the spindle hole is larger than a diameter of a bottom end of the spindle hole but smaller than a diameter of the screw groove, and the spindle hole comprises a stepped portion between the upper end and the bottom end;

wherein the spinning spindle is inserted through the screw groove and into the spindle hole, and the spinning spindle is retained and fixed to the spindle hole such that the prefabricated tuned top is spinnable by user's fingers; and wherein the rim comprises crash form portions formed on an outer circumferential surface of the rim, the crash form portion being embossed, engraved or formed in combination of embossment and engraving.

2. The prefabricated tuned top of claim 1, wherein a height of the knob protruding from a surface of the rim is longer than a length of the body from a bottom end of the body to the surface of the rim.

3. The prefabricated tuned top of claim 1, wherein the body further comprises an iron bead groove formed away from the screw groove to have a radius larger than a radius of the screw groove; wherein the iron bead groove is partitioned into a plurality of spaces by partition walls; and wherein the iron beads are arranged in the partitioned spaces.

4. The prefabricated tuned top of claim 1, further comprising a plurality of protrusions protruding from an upper surface of the body and a plurality of reverse prevention grooves on a bottom surface of the knob to engage with the plurality of protrusions to prevent loosening of the knob from the body.

5. A prefabricated tuned top spinnable by a launcher, comprising:

a body comprising a spindle hole vertically penetrating through a center of the body, and an iron bead groove formed to have a diameter larger than that of the spindle hole and hollowed downwards in a concentric circle with the spindle hole;

a spinning spindle inserted into the spindle hole such that only a portion of a lower end of the spinning spindle is exposed;

a rim positioned on the body to be retained thereto;

a plurality of iron beads accommodated in the iron bead groove and varying a center of gravity according to arrangement forms of the iron beads accommodated in the iron bead groove;

a cover arranged in the rim and comprising a knob through hole perforated at the center and a knob recess formed to have a diameter larger than that of the knob through hole;

a knob screwed to the spindle hole after passing through the knob through hole, the knob comprising a knob flange formed on a circumference of the knob, a knob pinion protruding from an upper surface of the knob flange and a retaining flange formed at an upper end of the knob pinion;

a spring interposed between a lower end of the knob and an upper end of the spinning spindle; and wherein the rim comprises crash form portions formed on an outer circumferential surface of the rim, the crash form portion being embossed, engraved or formed in combination of embossment and engraving.

6. The prefabricated tuned top of claim 5, wherein the plurality of iron beads is arranged in the iron bead groove in a single layer or in multiple layers.

7. The prefabricated tuned top of claim 6, wherein the plurality of iron beads is arranged in the iron bead groove in a single row or in multiple rows.

8. The prefabricated tuned top of claim 5, wherein the iron bead groove is partitioned into a plurality of spaces by partition walls, and the plurality of iron beads is partitioned and arranged in the partitioned spaces.

9. The prefabricated tuned top of claim 5, wherein a chamber is formed between the iron bead groove and the spindle hole to accommodate the plurality of iron beads in the chamber.

10. The prefabricated tuned top of claim 5, wherein a plurality of stopper blocks protrude from an upper surface of the body outside the iron bead groove, and engaging parts are formed on an inner circumferential surface of the rim, the engaging parts being fitted between the stopper blocks and positioned on the upper surface of the body.

11. The prefabricated tuned top of claim 10, wherein reverse rotation preventing protrusions of a semicircular shape are formed on upper surfaces of the stopper blocks, and a plurality of reverse rotation preventing groove are formed on a circumference of a bottom surface of the cover to engage with the reverse rotation preventing protrusions.

12. A launcher comprising the prefabricated tuned top of claim 5, further comprising:

a lower base comprising a knob insertion hole formed at a center of the lower base and the knob pinion being insertable into the knob insertion hole, and winder insertion grooves formed at one side or both sides of the lower base such that the knob insertion hole is interposed therebetween;

an upper base mateable to the lower base; and a winder fittable into the winder insertion groove and the winder comprising rack gears formed on both sides thereof.

13. An assembly comprising a plurality of launchers of claim 12, wherein said plurality of launchers is arranged in a stack, and each winder is configured to be insertable in any one of the plurality of launchers.

14. An assembly comprising a plurality of launchers of claim 12, wherein said plurality of launchers is arranged side-by-side, and each winder is configured to be insertable in any one of the plurality of launchers.

15. An assembly comprising a plurality of launchers of claim 12, wherein said plurality of launchers is arranged side-by-side in a stack, and each winder is configured to be insertable in any one of the plurality of launchers.

* * * * *